US005375668A

United States Patent [19]

Hallundbaek

[11] Patent Number: 5,375,668

[45] Date of Patent: Dec. 27, 1994

[54] BOREHOLE, AS WELL AS A METHOD AND AN APPARATUS FOR FORMING IT

[75] Inventor: Jorgen Hallundbaek, Lyngby, Denmark

[73] Assignee: H T C A/S, Glostrup, Denmark

[21] Appl. No.: 941,102

[22] PCT Filed: Jan. 25, 1991

[86] PCT No.: PCT/DK91/00023

§ 371 Date: Oct. 19, 1992

§ 102(e) Date: Oct. 19, 1992

[87] PCT Pub. No.: WO91/16520

PCT Pub. Date: Oct. 31, 1991

[30] Foreign Application Priority Data

Apr. 12, 1990 [CA] Canada ..... 2014536-6

[51] Int. Cl.[5] ..... F21B 7/00

[52] U.S. Cl. ..... 175/53; 175/19

[58] Field of Search ..... 175/19–21, 175/53

[56] References Cited

U.S. PATENT DOCUMENTS

| | | | |
|---|---|---|---|
| 4,193,461 | 3/1980 | Lamberton et al. . | |
| 4,496,011 | 1/1985 | Mazo et al. | 175/19 |
| 4,570,723 | 2/1986 | Kostylev et al. | 175/19 X |
| 5,031,707 | 7/1991 | Gerasimenko et al. | 175/19 |

FOREIGN PATENT DOCUMENTS

| | | |
|---|---|---|
| 547821 | 11/1983 | Australia . |
| 395300 | 8/1977 | Sweden . |

*Primary Examiner*—Michael Powell Buiz

*Attorney, Agent, or Firm*—Merchant & Gould, Smith, Edell, Welter & Schmidt

[57] ABSTRACT

A borehole (2) serves to produce e.g. hydrocarbons in a preferably soft or relatively soft underground formation (1), such as chalk or sandstone. The borehole (2) is surrounded by a substantially tubular reinforcement shell (9), which consists of formation material so compressed that the solid components of the material are substantially crushed to particles, and these are bonded together by the fluid or viscous components of the material and/or drilling mud. The borehole (2) if formed by first predrilling a small hole and then rolling said hole up to final borehole diameter by compressing the formation so that a reinforcement shell (9) of the desired thickness is formed. A self-propelling drive assembly (5) with a plurality of driven, elastic rollers (6) is used for this process, said rollers successively rolling down the borehole wall (7) and transferring the pressure force and moment from the drill bit (3) to the wall (7). Hereby horizontal boreholes can be formed far deeper into shallow hydrocarbon-bearing strata of the type which are found e.g. in the underground below the North Sea, so that these can be exploited profitably.

8 Claims, 4 Drawing Sheets

Figure 1:
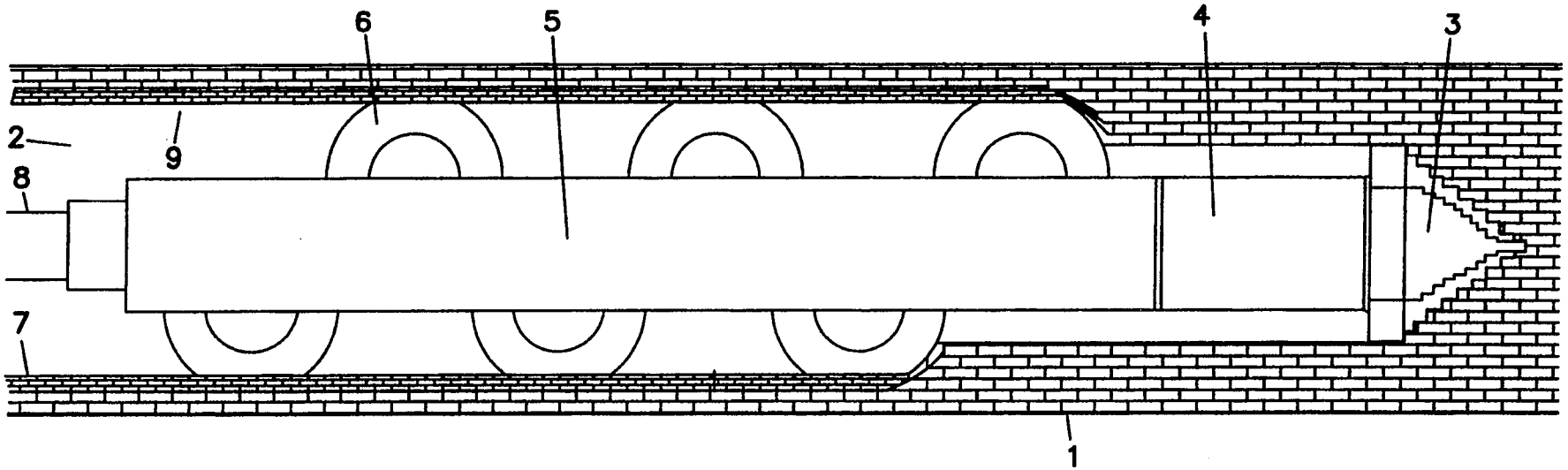

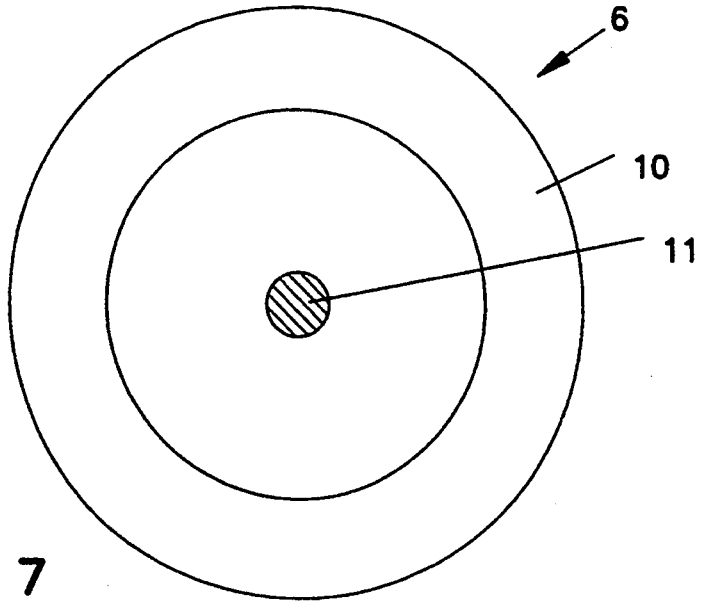
FIG. 7
FIG. 8
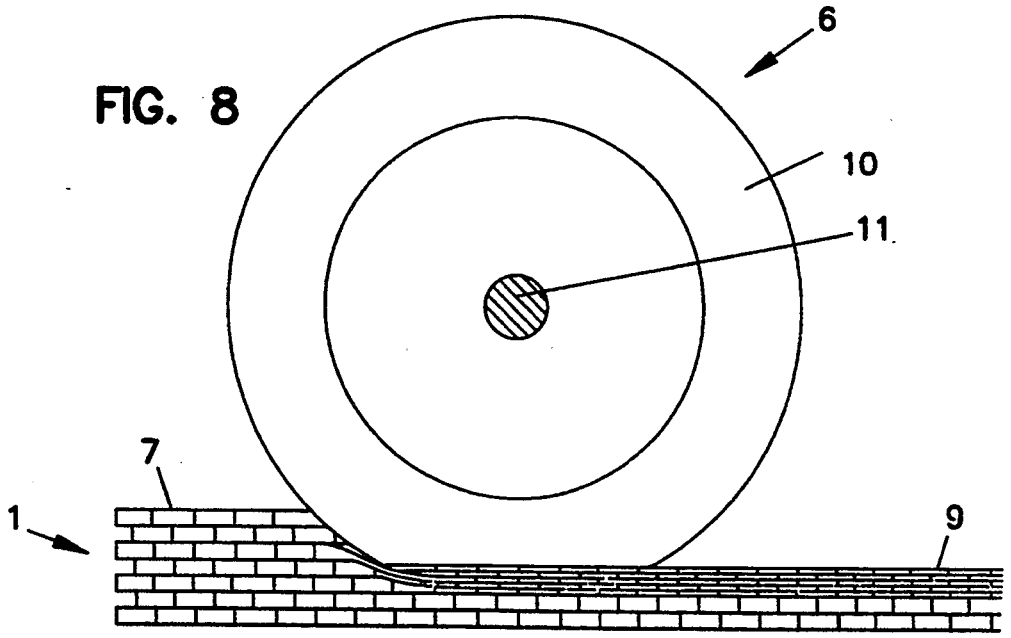
FIG. 9
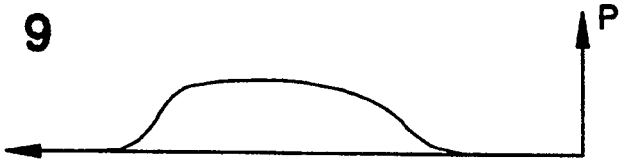

BOREHOLE, AS WELL AS A METHOD AND AN APPARATUS FOR FORMING IT

The invention concerns a borehole for producing e.g. hydrocarbons preferably in a soft or relatively soft underground formation, such as chalk or sandstone.

Such boreholes are drilled in most cases by means of drill bits which are tightened against the drill zone with a relatively large pressure. Usually, it causes no major problem to provide this pressure since the own weight of the drill string is used for this purpose as well as equipment on the surface, but in case of relatively inclined or horizontally extending holes there are limits to how far the pressure force can be introduced into a borehole in the formation in this manner. Today, however, there is a constantly increasing need for the ability to reach deeper into the shallow hydrocarbon-bearing strata, which are present e.g. in the underground below the North Sea, via horizontal holes so that it will be possible to exploit these fields economically. With this end in view, various self-moving or self-propelling drive assemblies have been developed, which can drive the drill bit forwardly through a horizontal hole in a formation, the reaction force from the drilling process being transferred to the wall of the borehole. This takes place in some methods by means of sets of clamping shoes which are alternately clamped against the wall of the borehole and are reciprocated axially with respect to each other, and in other methods by means of caterpillar belts or wheels which, to obtain a sufficiently great propulsion power, are provided with teeth to penetrate the relatively soft formations, such as chalk or sandstone which frequently constitute the main component of the above mentioned shallow, hydrocarbon-bearing strata. It is common to these known structures that they are able to impart a greater pressure force to the bit than has been possible in the past solely with the own weight of the drill string and the surface equipment, but this has been at the expense of the borehole wall which is seriously damaged when clamping shoes are used, or are torn when wheels caterpillar belts with teeth are used. This per se involves a new problem which limits the usefulness of the these methods since it is frequently necessary to pull the drive assembly in and out of the borehole to change the worn drill bit, and this is difficult or impossible in long boreholes when the borehole wall has been damaged, and the hole has therefore collapsed to a greater or smaller degree.

Moreover, the patent publications SE-B-395,300, U.S. Pat. No. 4,193,461 and AU-B-547,821 disclose methods and devices for driving underground holes or galleries in plastically deformable soil, such as clay. To this end there is used a tapered, conical tool which is screwed into the soil by means of rollers, augers or a combination of these to displace the soil substantially radially outwardly in the surrounding soil, which is consolidated in a region of considerable thickness around the underground hole. The soil is now so much stiffer and stronger in this region that the hole does not collapse. The method is useful for forming underground holes in soil, such as clay, where no great requirements are made with respect to the ability of the hole wall to mechanically withstand e.g. a flow of drilling mud and the wheel pressure of a self-propelling drilling tool. A travelling path proper for such a driving tool is not involved at all; on the contrary, the rollers or augers of the known tapered, conical tools cut into the wall of the underground hole. In fact, the mentioned publications state that after withdrawal of the tool the hole may be filled with concrete to form a load supporting column. The publication AU-B-84028 moreover discloses a method whereby such a liner may be formed while driving the underground hole. It is common to the methods and devices known from the above-mentioned patent publications that they are vitiated by the drawback that they can only be used for plastically deformable soil, such as clay, but not for firmer underground formations, such as chalk or sandstone requiring the material to be substantially drilled out and removed from the borehole.

The object of the invention is therefore to provide a borehole of the type mentioned in the opening paragraph for producing e.g. hydrocarbons in particular from relatively soft formations, said borehole having a wall which can absorb the reaction force from the drilling process better than known before without being damaged considerably, and which can moreover stand being flushed by the mud return flow without eroding.

This is achieved according to the invention in that the borehole is characterized by being surrounded by one substantially tubular reinforcement shell which consists of formation material so compressed that the solid components of the material are substantially crushed to particles, and these are bonded together by the fluid or viscous components of the material and/or drilling mud. The wall of the borehole is hereby reinforced in a simple and inexpensive manner so that it can be used as a travelling path for a self-propelling drive assembly, carrying the drill bit, without being damaged considerably, is able to absorb the reaction force from the drill bit during the drilling process and can stand the strong mud return flow from the drill zone without being eroded.

According to the invention, in particularly advantageous embodiments of the borehole the reinforcement shell has a thickness of between 2 and 10 mm, preferably between 2 and 6 mm, and in particular between 3 and 5 mm.

The invention also concerns a method of forming a borehole of the above mentioned type where the borehole is expanded by rolling, and this method is characterized according to the invention by first predrilling in the formation a hole with a smaller diameter than the final diameter of the borehole, and then expanding said pre-drilled hole to final borehole diameter by translatorily rolling the material of the formation so that the solid components of the material substantially in a depth corresponding to the desired thickness of the reinforcement shell are crushed to particles, and these are bonded together by the fluid or viscous components of the material and/or drilling mud. This entails that the reinforcement shell of the borehole is advantageously formed during the actual drilling process, and at the same time the wall zones which successively serve to absorb the reaction forces from the drill process get such a compacted state that they cannot be damaged by this load.

According to the invention, the compressing can take place by rolling down the wall of the predrilled hole with a suitable number of rollers so that any point on said wall is passed at least once by a roller in a manner such that it is successively subjected to a pressure, where the solid components of the material are substantially crushed to particles, and then are bonded together by the fluid or viscous components of the material and/or drilling mud, following which the pressure gradually diminishes again from said size to zero. When the borehole wall is rolled down in this manner it has surprisingly been found in a series of tests performed by the inventor at the Danish Geotechnical Institute in connection with a project for developing drilling equipment for forming horizontal boreholes in relatively soft formations, such as chalk, likewise performed by the inventor in 1987 and 1988 at the Technical University of Denmark that the maximum size of the traction force is not determined by the friction between the rollers and the formation material, but by its own shear strength, and that if subsidence occurs, the subsidence will not, as expected, take place between the rollers and the formation material, but as shear inside it at a distance from the inner side of the borehole.

Moreover, according to the invention, in a particularly advantageous embodiment of the method the drilling pressure and the drilling moment may be transferred to the borehole wall via the rollers, and these may be positively drawn.

The invention also concerns an apparatus serving to perform the above mentioned method, said apparatus comprising a drilling tool, e.g. a drill bit and a self-propelling drive assembly connected with it and having rollers for expanding the borehole and for advancing the drilling tool and imparting to it the drilling pressure and moment necessary for performing the drilling. According to the invention, this apparatus is characterized in that the rollers are constructed to advance the drilling tool substantially translatorily in the borehole, each of which rollers is suspended and guided so as to be kept engaged with the borehole wall with a maximum specific engagement pressure, where the solid components of the material are substantially crushed to the particles, and these are bonded together by the fluid or viscous components of the material and/or drilling mud. This structure is particularly simple and expedient since it serves to advance and drive the drilling tool into the drill zone and also to roll down the wall of the predrilled hole so as to form, as desired, a compressed reinforcement shell on which the drive assembly can travel when it has to be reciprocated in the boreholes, often several kilometers long, when the drilling tool has to be exchanged.

According to the invention, each roller may be so adapted that its face, when loaded in a specific direction at right angles to it with a specific engagement pressure, where the solid components of the material are substantially crushed to particles, and these are bonded together by the fluid or viscous components of the material and/or drilling mud, is deformed elastically inwardly against the axis of rotation of the roller in a ratio of between 1 and 20% with respect to the radius of the roller, preferably between 3 and 15%, and in particular between 5 and 8%, whereby the roller may advantageously have a fixed hub which is surrounded by an elastic, preferably unpatterned tire of e.g. natural or synthetic rubber. This entails that the rollers are capable of draining viscous materials, such as mud, away from the traction zones of the borehole wall, and that the rolling down operation can take place without the deformed formation material sticking to the respective roller and being entrained upwardly as has been found to be the case when firm rollers of e.g. steel are used.

Moreover, according to the invention, each roller may be suspended and guided so that it can be moved from a position where its outermost point is substantially within or in the vicinity of the outer boundary of a self-propelling drive assembly, to a position where its outermost point is positioned at a distance from the central axis of the drive assembly corresponding approximately to twice the diameter of the borehole, and all rollers may moreover be driven by a common transmission so that they are caused to rotate with the same peripheral speed. This entails that the drive assembly is capable of travelling through e.g. washed borehole zones while retaining the constant engagement pressure of the rollers against the wall of the borehole, and it is furthermore ensured that the resulting traction force will be as great as possible since none of the rollers acts as a brake with respect to the other rollers.

Figure 2:
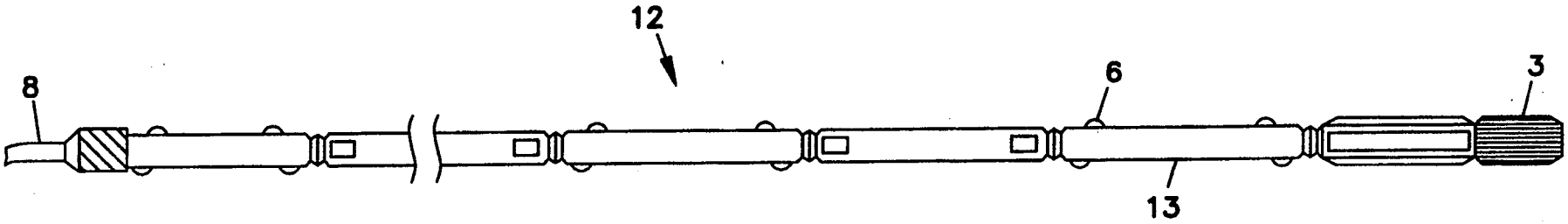
Figure 3:
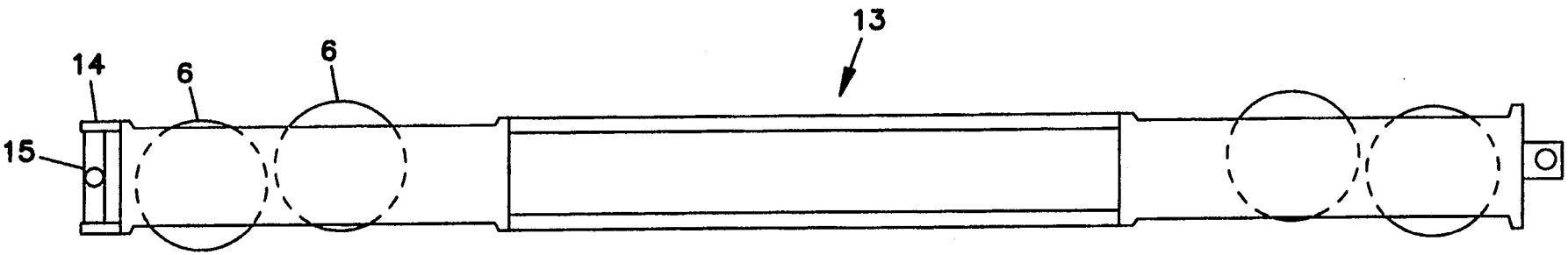
Figure 4:
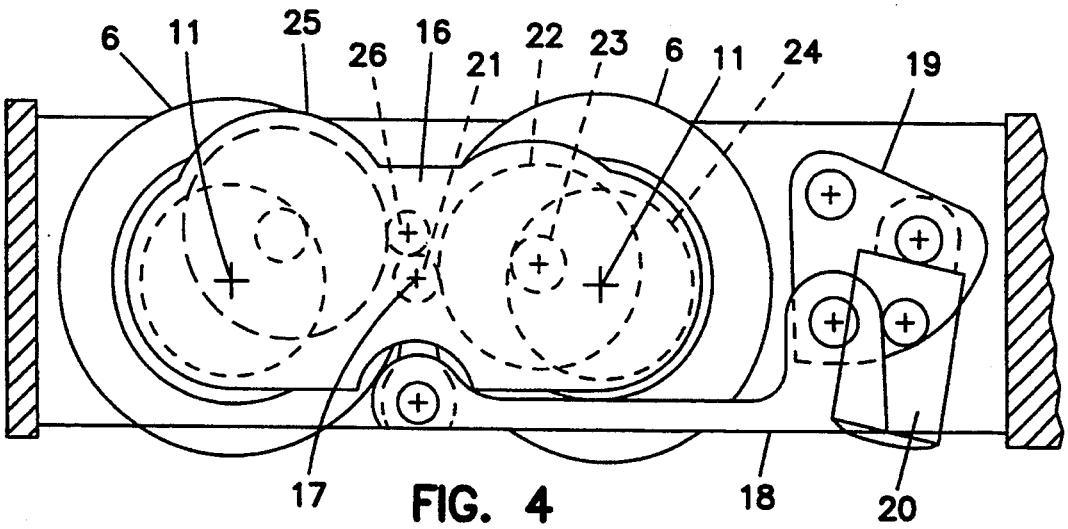
Figure 5:
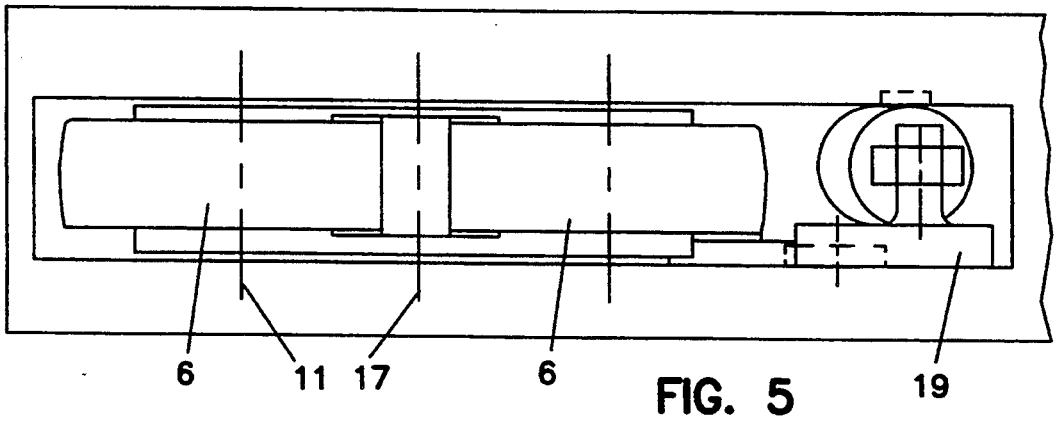
Figure 6:
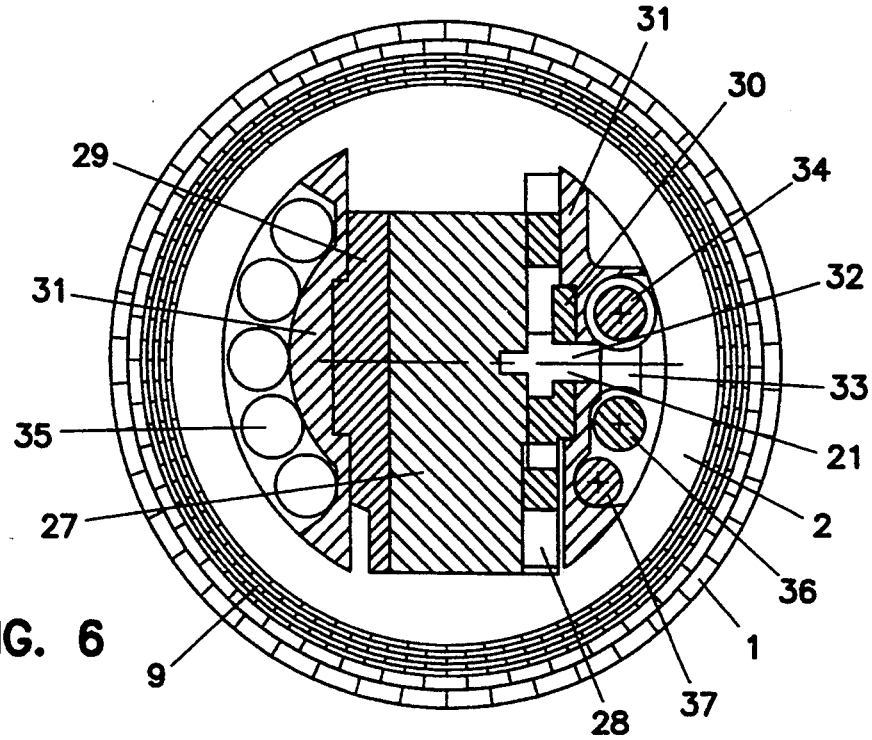

The invention will be explained more fully by the following description of embodiments which only serve as examples, with reference to the drawing, in which FIG. 1 schematically shows the outer end of a borehole which is drilled by means of a drill bit advanced by a self-propelling drive assembly, FIG. 2 schematically shows a self-propelling, jointed drive assembly with a drill bit, FIG. 3 is an enlarged view of one of the self-propelling drive links shown in FIG. 2, FIG. 4 is a section at a pair of rollers through the drive link shown in FIG. 3, FIG. 5 is a top view of the same, FIG. 6 is a section at the swing axis of a swing arm through the drive links shown in FIGS. 4 and 5, FIG. 7 is a side view of a roller with an elastic tire, in an unloaded state, FIG. 8 shows the same, but loaded by the engagement pressure against the wall of the borehole, and FIG. 9 is a diagram of the engagement pressure.

FIG. 1 shows an underground formation 1 which consists of a relatively soft material, such as chalk, lime or sandstone which is drilled to a borehole 2 by means of a drill bit 3, which is connected via a connecting member. 4 with a self-propelling drive assembly 5 which, with drawn rollers 6, travels on the wall 7 of the borehole 2. A flexible pipe or an armoured hose 8 serves to feed drilling mud to the drill zone from a station at the surface. Both the drill bit 3 and the rollers 6 may be driven by means of mud turbines (not shown) by this drilling mud, which is fed at such a considerable pressure such as e.g. 50–100 bars, or additionally an electric cable may be provided through the flexible hose to electric motors which can advantageously be used instead of mud turbines in certain cases.

As shown, the borehole is first predrilled to a diameter which is smaller than the final diameter of the borehole, and then the predrilled hole is rolled up to this diameter while the rollers roll along the borehole wall with a maximum specific engagement pressure, where the solid components of the material are substantially crushed To particles, and these are bonded together by the fluid or viscous components of the material and/or drilling mud. This pressure is quite considerable, e.g. between 2 MPa and 50 MPa, and this great load compresses the material so that it leaves a 2–10 mm thick reinforcement shell 9 which mechanically stabilizes the borehole and forms a durable travelling path which can withstand being repeatedly traversed by the drive assembly in connection with the exchange of worn drill bits, and can moreover withstand being flushed without erosion by the drilling mud which is discharged from the drill zone at a rate of e.g. between about 0.9 and 1.2 m/sec. and a positive pressure of a about 2 MPa.

FIG. 7 shows a roller 6 which is provided with an elastic tire 10 of natural or artificial rubber of a quality capable of withstanding the high pressures and temperatures which may occur in deep boreholes. The roller has moreover a shaft 11 and may, as previously mentioned, be caused to rotate about this shaft by means of a mud turbine or an electric motor.

FIG. 8 shows the same roller 6, bug now kept engaged with the wall 7 of the borehole with such a great engagement pressure that part of the formation material 1 has been compressed and converted to the reinforcement shell 9.

FIG. 9 is a diagram where the engagement pressure is plotted as the ordinate, and which illustrates in greater detail how the engagement pressure develops during the roller passage of a point on the borehole wall. Initially, the pressure is zero, but then it increases gradually to a pressure, where the solid components of the material are substantially crushed to particles, and these are bonded together by the fluid of viscous components of the material and/or drilling mud. All viscous material, such as drilling mud, is pressed away from the contact face between the roller and the formation or pressed into its porosities at this pressure, and the formation material itself is compacted to a certain depth. In this pressure-loaded state the material adheres to the roller with an extremely great strength so that a surprisingly great traction force can be transferred in the boundary face between the roller and the formation material, the size of said traction force depending solely upon the shear strength in the actual pressure loaded and compacted formation material lying below the roller. Towards the end of the passage the pressure decreases gradually causing the state of the formation material to change so that its adhesive capacity diminishes. Since the travelling speed of the drive assembly is relatively small, e.g. between 1 and 150 meters per hour, the rolling will take place so slowly that the relieved formation begins to liberate viscous materials serving as a release agent in the boundary face between the formation and the roller. At the same time its surface is bent forwardly and rearwardly so that the boundary layer is subjected to shear tensions which, in connection with the reduced adhesive capacity and the liberated release agent, separate the reinforcement shell completely from the respective roller when its face leaves the borehole wall during the rotation.

The mentioned three conditions, which are a prerequisite for the borehole wall to be rolled down without simultaneously being damaged, cannot be established with e.g. firm steel rollers since these when rotating will pull the material out of the borehole wall, and the best result is obtained when the elastic tire of the roller itself is deformed between 1–20%, preferably between 3–15%, and in particular between 5–8% of the radius of the roller, during the compaction of the formation material.

Since, as previously mentioned, the maximum size of the friction force does not depend upon the friction between the roller and the formation material, additional traction forces cannot be transferred by providing the elastic tire with teeth, tines or serrations, and a tire with a smooth face is therefore preferred, which, during rolling, is most suitable for draining viscous materials, such as drilling mud flowing along the borehole wall, and which simultaneously imparts to it a smooth and even surface forming the best possible travelling path for the drive assembly and presents as little flow resistance as possible for the drilling mud which returns from the drill zone.

FIG.2 shows an embodiment of a drive assembly 12 which is composed of a number of mutually freely swingably connected drive links 13, each of which is provided with a plurality of rollers 6. The front drive link is connected with a drill bit 3 via a connecting member 4, e.g. a bent sub. The rear drive link is connected with a flexible pipe or an armoured hose 8 for drilling mud and for advancing an electric cable (not shown). By means of this structure the drive assembly, although it has a considerable longitudinal extent, is capable of turning with a relatively small radius from a vertical borehole and continuing in a horizontal borehole. Owing to the large number of rollers 6 of the drive assembly such a great overall traction force can be obtained that the horizontal borehole can be provided considerably deeper in a horizontal formation than known in the past, while the drive assembly is capable of pulling a drill string all the way after it into the formed borehole. Hereby, it is now profitable to exploit the shallow, horizontal hydrocarbon-bearing formations which are found e.g. in the underground below the North Sea. As shown, the rollers 6 are distributed with such relatively great mutual spacing, in the longitudinal direction of the drive assembly so that the strong mud return flow running between the drive assembly and the borehole wall can easily pass the rollers. The traction force is distributed at the same time over such a large distance in the longitudinal direction of the borehole wall that the drive assembly retains at least part of the traction force although it passes e.g. washed regions where some of the rollers are disengaged from the wall. Generally, the drilling moment advantageously rotates the drive assembly slowly about its axis so that the predrilled hole is rolled evenly upwardly along the entire wall, and the additionally ensure this the rollers are angularly spaced with respect to each other about the axis of the drive assembly.

FIG.3 is an enlarged view of a single drive link 13 which has a pair of rollers 6,6 at each end part. The horizontal end walls of the drive link moreover mount universal couplings in the form of pairs of brackets 14 and universal joints 15 for coupling the individual drive links 13 with each other.

It appears more fully from FIGS. 4–6 how the roller pairs shown in FIG. 3 are suspended and guided. FIG. 4 shows an axial section through a drive link 13 with a roller pair 6,6. The swing arm 16 can swing about a central transverse axis 17, it being connected via a drawbar 18 with a swing bracket 19 which can be swung by an activation cylinder 20 to thereby force the rollers 6,6 outwardly against the borehole wall at their respective sides of the drive link 13.

The rollers 6,6 are driven by means of a shaft mounted coaxially with the swing axis, said shaft mounting a drive 21 which meshes with a gear wheel 22, which in turn mounts a drive 23 which meshes with a toothing 24 provided inwardly in the roller 6. The other roller is driven correspondingly, an idler wheel 26 being inserted between the drive 21 and a gear wheel 25 corresponding to the gear wheel 22.

FIG. 5 shows this arrangement from above. As shown, the swing arm is constructed as a double fork whose one side is occupied by the above-mentioned gear wheel transmission which is engaged in a flat box. The gear wheel transmission and the swing arms are preferably made as flat as possible so that the rollers 6,6 may be dimensioned as wide as possible, and so that sufficient space is left for advancing hoses for drilling mud and transmission shafts for driving the rollers.

FIG. 6 is a section through the drive link 13 at the central transverse axis 17 of the swing arm 16. The swing arm 16 has a solid central part 27 with journals for the drawbar 18, and it can swing about two short pins 29,30, each of which has a relatively large diameter and is journalled in the chassis 31 of the drive link 13. The drive shaft 32 for the gear wheel drive 21 is passed through the pin 30, and outside this the shaft 32 is provided with a worm wheel 33 driven by a worm on a through-going drive shaft 34. By means of universal joints and axially movable couplings the drive shaft may be connected with the corresponding drive shafts in the other drive links, so that all rollers in the drive assembly will rotate synchroniously, thereby providing for maximum traction force since none of the rollers will serve as a brake with respect to the others. As shown, space is left in the chassis of the drive link 13 partly for a plurality of hoses 35 serving to supply the drilling mud to the drill bit, partly for additional drive shafts 36,37 for operating e.g. the drill bit.

By means of the roller suspension described above the rollers may in a balanced state be moved from a position in the vicinity of the actual drive assembly to a position around the double diameter of the borehole, thereby ensuring that each roller maintains its engagement with the borehole wall even though the diameter of the borehole varies relatively much during the passage of e.g. washed formation regions. The elastic tires of the rollers additionally contribute to this effect.

Instead of being suspended as described above, the rollers may also be suspended (not shown) such that the resistance per se offered by the formation against rolling entails that the engagement pressure of the rollers is increased.

The axes of rotation of the rollers may moreover form a suitable angle with the direction of transport instead of being at right angles to it, so that, during rolling, each roller will describe a helical line along the borehole wall with simultaneous rotation of the drive assembly.

If the borehole is not to follow a highly curved course, a relatively long drive assembly may also be made in one piece of a single long, suitably flexible pipe instead of being composed of a plurality of mutually swingable links. This provides a simpler structure which is more reliable in operation.

The drive assembly may also incorporate drive means in the form of mud turbines or electric motors for driving the rollers and the drill bit as well as various electric measuring and drilling equipment of a type known per se.

I claim:

1. A method of forming a borehole for producing e.g. hydrocarbons preferably in a soft or relatively soft underground formation (1), such as chalk or sandstone, where where the borehole (2) is expanded by rolling, characterized by first predrilling in the formation a hole with a smaller diameter than the final diameter of the borehole (2), and then expanding said predrilled hole to final borehole diameter by translatorily rolling the material of the formation (1) so that the solid components of the material in a depth corresponding to the desired thickness of the reinforcement shell are substantially crushed, and these are bonded together by the fluid or viscous components of the material and/or drilling mud.

2. A method according to claim 1, characterized in that compression takes place by rolling down the wall (7) of the predrilled hole with a suitable number of rollers (6) so that any point on said wall (7) is passed at least once by a roller (6) in a manner such that it is successively subjected to a pressure, where the solid components of the material are substantially crushed to particles, and these are bonded together by the fluid or viscous components of the material and/or drilling mud, following which the pressure gradually diminishes again from said size to zero.

3. A method according to claim 1 characterized by transferring at least part of the drilling pressure and moment to the borehole wall (7) via the rollers (6), said rollers (6) being positively driven.

4. An apparatus for performing the method according to claim 3, comprising a drilling tool (3) e.g. a drill bit and a self-propelling drive assembly (5) connected with it and having rollers for expanding the borehole (2) and for advancing the drilling tool (3) and imparting to it the drilling pressure and moment necessary for performing the drilling, characterized in that the rollers (6) are constructed to advance the drilling tool (3) substantially translatorily in the borehole (2), each of which rollers (6) is suspended and guided so as to be kept engaged with the borehole wall (7) with a maximum specific engagement pressure, where the solid components of the material are substantially crushed to particles, and these are bonded together by the fluid or viscous components of the material and/or drilling mud.

5. An apparatus according to claim 4, characterized in that each roller (6) is so adapted that its face, when loaded in a specific direction at right angles to it with a specific engagement pressure, where the solid components of the material are substantially crushed to particles, and these are bonded together by the fluid or viscous components of the material and/or drilling mud, is deformed elastically inwardly against the axis of rotation of the roller (6) in a ratio of between 1 and 20% with respect to the radius of the roller, preferably between 3 and 15%, and in particular between 5 and 8%.

6. An apparatus according to claim 4, characterized in that the roller (6) has a firm hub which is surrounded by an elastic, preferably unpatterned tire (10) of e.g. natural or synthetic rubber.

7. An apparatus according to claim 6, characterized in that each roller (6) is suspended and guided so that it can be moved from a position where its outermost point is substantially within or in the vicinity of the outer boundary of the self-propelling drive assembly, to a position where its outermost point is positioned at a distance from the central axis of the drive assembly corresponding approximately to twice the diameter of the borehole.

8. An apparatus according to claim 7, characterized in that all rollers (6) are driven by a common transmission such as to be caused rotate with the same peripheral speed.

* * * * *